United States Patent [19]

Mehnert

[11] 4,120,486

[45] Oct. 17, 1978

[54] METHOD AND APPARATUS FOR THE SLIP-FREE HAULING OF A ROPE OR THE LIKE

[75] Inventor: Walter Mehnert, Ottobrunn, Fed. Rep. of Germany

[73] Assignee: Director Ing. Fritz Loertscher, Flums/SG, Switzerland

[21] Appl. No.: 761,880

[22] Filed: Jan. 24, 1977

[30] Foreign Application Priority Data

Jan. 29, 1976 [DE] Fed. Rep. of Germany ..... 2603202
Aug. 5, 1976 [DE] Fed. Rep. of Germany ..... 2635267

[51] Int. Cl.[2] ..... B66D 1/30

[52] U.S. Cl. ..... 254/150 R; 74/812; 192/18 R

[58] Field of Search ..... 254/150 R, 138, 187.4, 254/186 HC; 74/812, 810, 191, 230.1 R; 192/18 R, 70.29, 70.3

[56] References Cited

U.S. PATENT DOCUMENTS

| | | | |
|---|---|---|---|
| 967,331 | 8/1910 | Covell | 254/150 R |
| 2,175,382 | 10/1939 | Eason | 254/187.4 |
| 2,388,857 | 11/1945 | Lindsley | 254/150 R |
| 3,570,815 | 3/1971 | Nelson | 254/150 R |
| 3,643,921 | 2/1972 | Puretic | 254/138 |
| 3,728,914 | 4/1973 | Guangorena et al. | 254/150 R |
| 3,927,580 | 12/1975 | Fawcett | 254/150 R |
| 3,985,340 | 10/1976 | Guangorena | 254/150 R |

*Primary Examiner*—Trygve M. Blix
*Assistant Examiner*—Kenneth W. Noland
*Attorney, Agent, or Firm*—W. G. Fasse; W. W. Roberts

[57] ABSTRACT

A method for the slip-free hauling of a rope, or similar, flexible force transmitting element, comprises guiding, moving, and controlling the rope over and/or by ways of a clamping roller or pulley resulting in a looping angle of less than 360°. The rope may be moved and controlled either directly by hand or with a control device. A slip-free hauling apparatus comprises a housing, a clamping pulley, a relative and/or an absolute arresting system, in an operating or control device, a gearing system and a brake clutch. The gearing system is used to step down the force of the rope. The control device is used to modify the slippage of the rope. An auxiliary device initiates and controls the braking, releasing, and arresting of the rope.

36 Claims, 8 Drawing Figures

Fig. 2
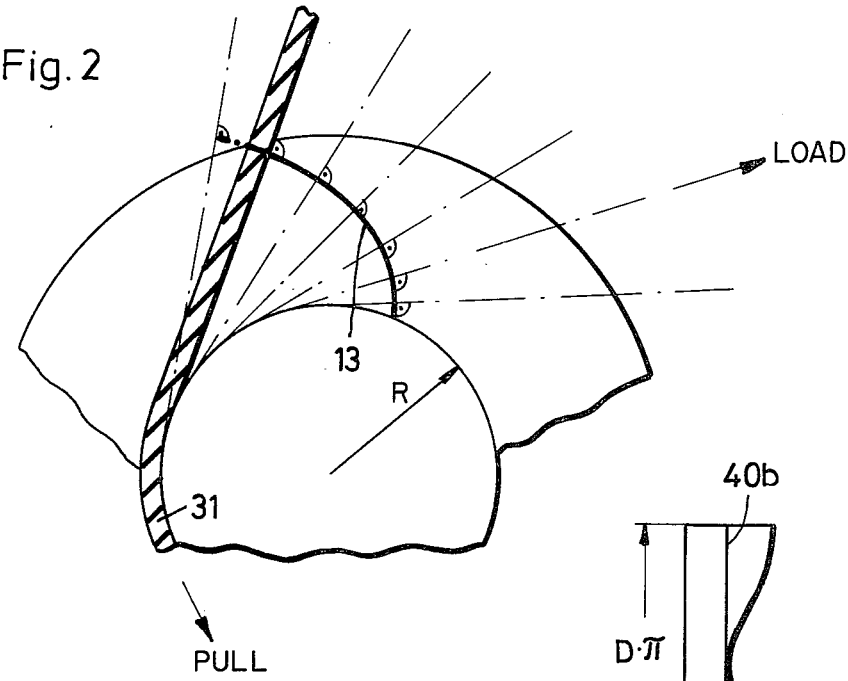
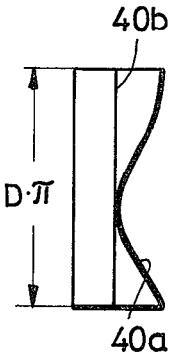
Fig. 2a
Fig.3
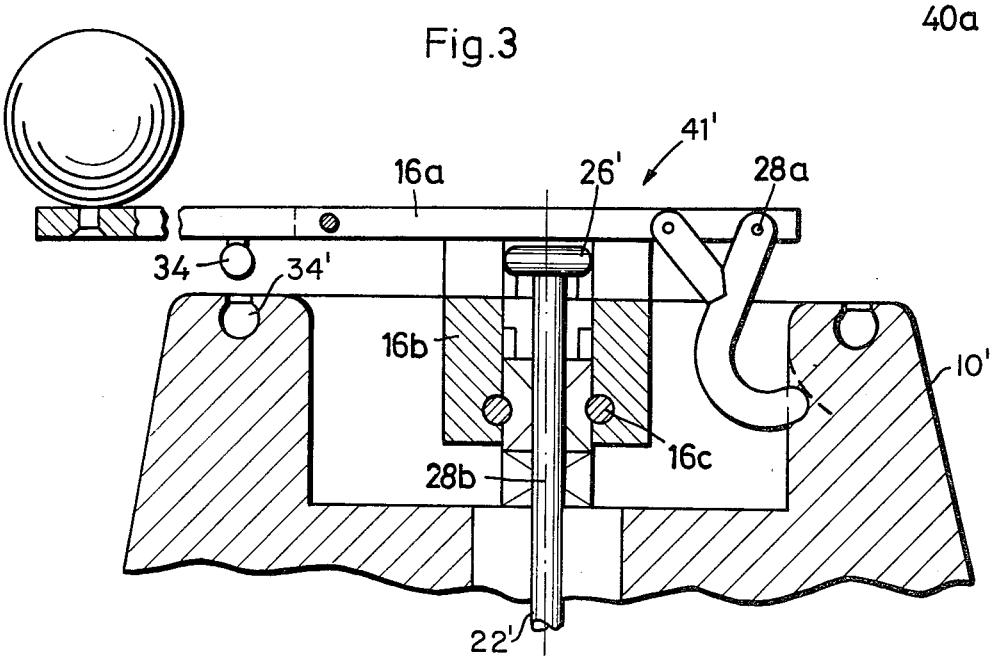

METHOD AND APPARATUS FOR THE SLIP-FREE HAULING OF A ROPE OR THE LIKE

BACKGROUND OF THE INVENTION

The invention relates to a method and apparatus for the slip-free hauling or heaving of a rope of similar, flexible power transmitting elements.

Hauling methods and arrangements are known in diverse forms and are used for various purposes. For example, such hauling devices are known from the German Patent Publications DOS 2,311,912 and DAS 1,556,458. The arrangements of DOS 2,311,912 include power transmission devices and are constructed a differential gear means. These devices are also provided with auxiliary brakes for the rope pay out. The apparatus of DAS 1,556,458 is constructed for performing an automatic adjustment to compensate for a horizontal shift of a boat or ship.

These prior art devices have their practical limitations expecially with regard to construction costs. In addition, these devices are restricted with regard to their installation and their use. Besides, the functional safety and reliability of operation of these known devices are often inadequate.

German Patent Publication DAS 1,028,454 discloses a capstan or windlass for sailing sheets which has two locking pawls working on a gear wheel connected to the capstan head. One of these locking pawls is pivoted or hingedly connected to a base plate. The other pawl is hingedly connected to an operating lever movable back and forth on a circular path. The operating lever, in turn is supported so that it is rotatable about the capstan journal. In this case, the capstan head and spur gear form an integral structure and turn about a journal. This journal, likewise, forms an integral structure with the base of the device. In this device, two spring-loaded holding or locking pawls engage the spur gear. However, such a device requires that the rope is looped completely around the capstan head at least once. The rope must even be looped around the capstan head several times if large forces are to be transmitted. In this case, the rope must also be fixed by a clamping device. Numerous accidents have been caused just be releasing the rope from the clamping device. The hands of the operator are placed in danger and may get clamped off or may get caught, particularly when higher forces and accelerations are involved.

The German Patent Publication DOS 2,155,904 discloses a sailing winch which is arranged for several speeds. The winch has a direct drive with two speed reductions. This winch comprises a rope hoisting drum, a drive shaft, and one hand crank. The hand crank drives the hoisting drum through the drive shaft by means of two wheel blocks or pulleys. These pulleys are connected to the drive shaft by a drive means which is effective in one direction. In addition, the pulleys also have a direct drive. This direct drive comprises one drive connection which operates in one direction, and liftable locking pawls, friction rollers or other mechanical connecting means. The rope hoisting drum is rotated in one defined direction by means of said hand crank.

All of the above arrangements or devices have numerous deficiencies. On the one hand, these devices require an auxiliary clamping and holding mechanism which tightens or holds the rope around the winch. On the other, a supplemental auxiliary force or helper is required even when relatively small forces are to be handled. Also, the rope must loop around the winch roller or drum several times to form several turns.

The German Patent Publication DOS 1,920,789 describes a winch block comprising a disengageable ratchet which blocks rotation in one direction in a form locking manner. The winch block also includes a rope pulley which allegedly receives the sheet in a self-locking manner. The rope pulley has at least one centrally arranged gear system. This gear system cooperates with at least one locking pawl that is capable of free tilting movement. Spring biasing means keep the locking pawl and gear engaged. A radial notch or recess which permits the free movement of the locking pawl, is arranged between a shoulder supporting the locking pawl in the radial direction and the following locking tooth. A shoulder is provided for each locking tooth and the teeth and shoulders are arranged on the same side of the rope pulley as viewed in the same circumferential direction of the pulley.

However, in such an arrangement the probability of proper engaging and disengaging of the locking pawl is small indeed. Hence the operation and reliability of this type of device leave room for improvement. On the other hand, this known device does not provide any self-locking worth mentioning since the rope slips through even with minimal loading forces. Such slipping of the rope must be expected because of the centrally arranged gear system.

OBJECTS OF THE INVENTION

In view of the foregoing, it is the aim of the invention to achieve the following objects, singly or in combination:

to provide a method and arrangement for the slip-free hauling of a rope or the like which overcomes the disadvantages of the prior art even with looping angles smaller than 360°;

to provide a slip-free hauling method and apparatus in which no undefined conditions or situations exist;

to provide a slip-free hauling method and arrangement in which the rope is guided, moved, and controlled by means of a clamping roller or pulley;

to provide a slip-free hauling method and arrangement in which the rope may be moved and controlled either directly by hand or by a control device, at the input of which the force of the rope is geared down and/or altered through slippage; and to provide a slip-free hauling arrangement in which the operating lever is an integral component part of a space-saving, accident-proof unit which is ready for service at any time.

SUMMARY OF THE INVENTION

According to the invention, there is provided a method for the slip-free hauling of a rope, or the like, comprising guiding, moving, and controlling the rope by means of a clamping roller or pulley and providing a looping angle of less than 360° of said rope around said clamping roller or pulley. The rope may be moved and controlled either directly by hand or by means of a control device such as a winch. The control device steps down the force of the rope at its input and/or modifies said rope force by means of slippage.

Due to the above features of the invention, it is possible to move and arrest the motion of the rope by means of the clamping pulley without any delay and without any difficulties. For relatively small forces, the free choice between "locked return direction" or "free return direction" remains unrestricted and the selection may simply be made by hand. However, if high forces occur, the rope is moved by means of translational gears. Even in this case, the aid of a second person is not necessary as it has been in the past. If it is so desired, the rope may be released immediately to allow a return motion. The rope may also be braked in a defined manner.

It is an important advantage of the invention that the return motion of the rope is now controlled exclusively with the bearing friction of the pulley and subjecting the winch to the full friction of the rope is avoided. Thus, there is almost no wear and tear on the rope and safety risks are thus eliminated by the invention.

According to the invention, the control means, including any auxiliary devices, is moved in at least three directions in order to move and control the rope. Thus, the rope or sheet may be released and controlled without delay in an operation which requires only one hand. This one hand operation of a sheet is true for all operating conditions and circumstances, whereby the operational reliability and safety is substantially increased as compared to the prior art.

In one embodiment, the number of degrees of freedom of the control device is utilized in an optimal manner. Therefore, the functional range may be increased, for example, by using several rotation and force transmission ratios without substantially enlarging the structural dimensions of the present winch.

An apparatus of the invention for performing the method of the invention comprises a clamping pulley or roller rotatably mounted in a housing adjacent to a relative arresting system, and/or an absolute arresting system which cooperates with a control device. This system is connected directly to the clamping pulley. A force reduction gear drive and/or a brake coupling may be arranged between the two arresting systems. The brake coupling may be connected to the gear drive. In a different embodiment, the gear drive and brake coupling may be arranged between the pulley and the absolute arresting system. One or several spring systems cooperate with the brake coupling. An auxiliary device is also included to initiate and control the conditions of: braking, releasing, and arresting the motion of the sheet. This combination of elements provides a maximum of comfortable use and safety in the operation of the present sheet control apparatus.

BRIEF FIGURE DESCRIPTION

In order that the invention may be clearly understood, it will now be described, by way of example, with reference to the accompanying drawings, wherein:

FIG. 2 shows a schematic illustration of the clamping profile curve generated by the unwinding rope;

Figure 1:
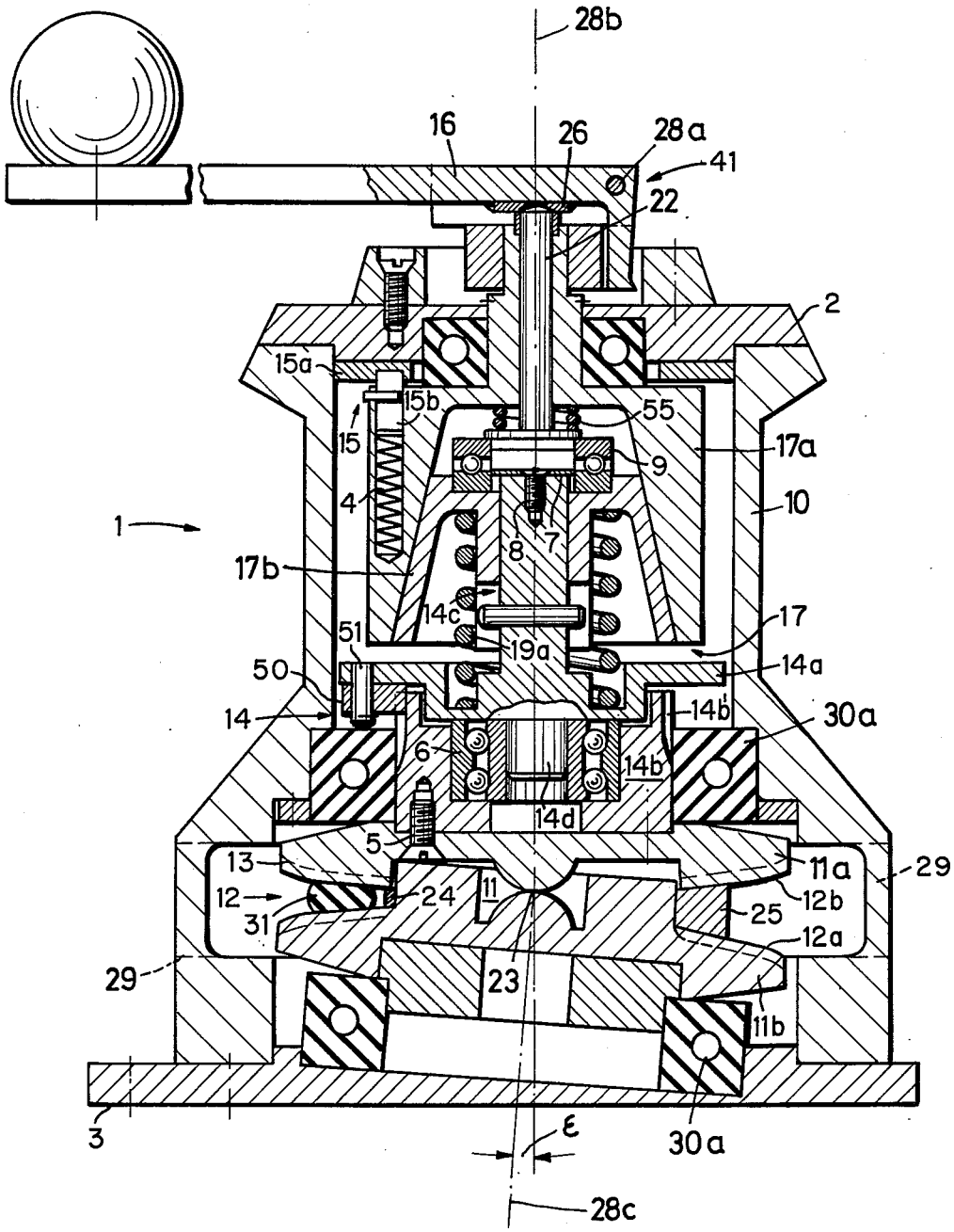
FIG. 1 is an axial section through a winch type apparatus for the slip-free hauling of a sheet with so called digital brake means and with a simple operating arrangement, according to the invention, but without translational gear means.
Figure 4:
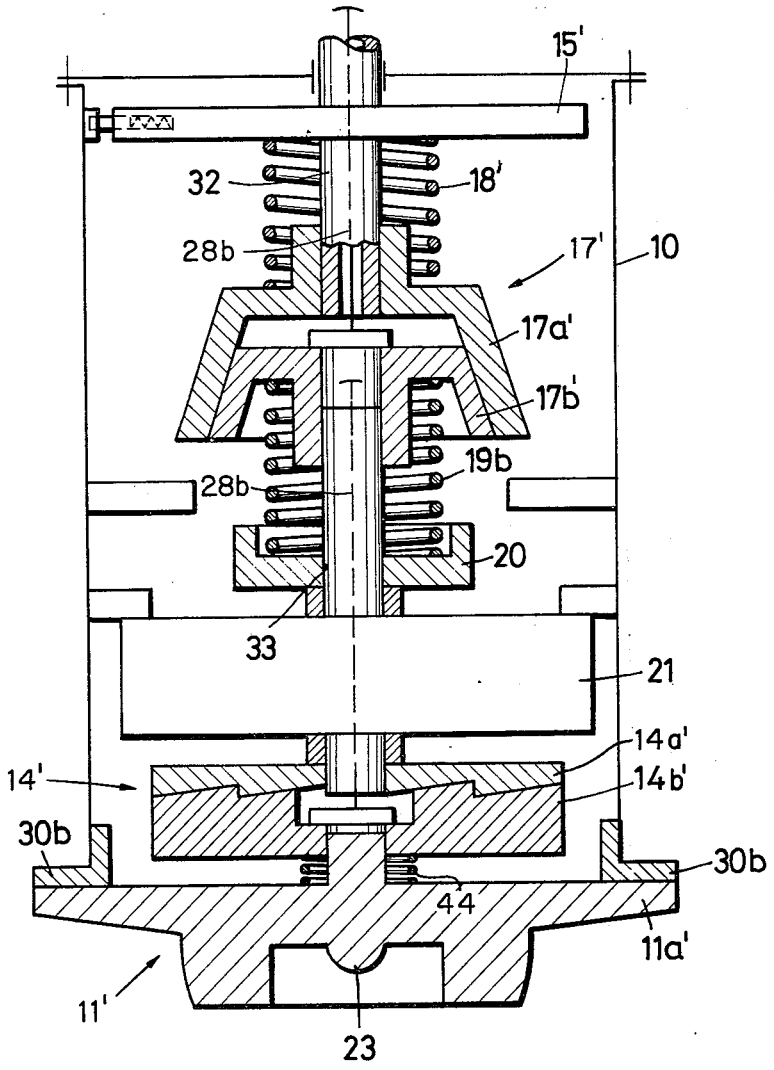
Figure 5:
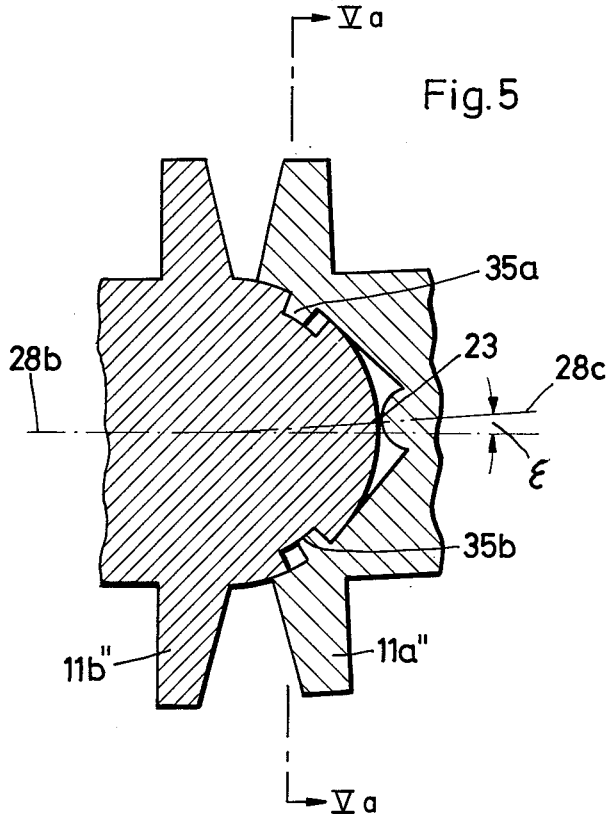
Figure 5A:
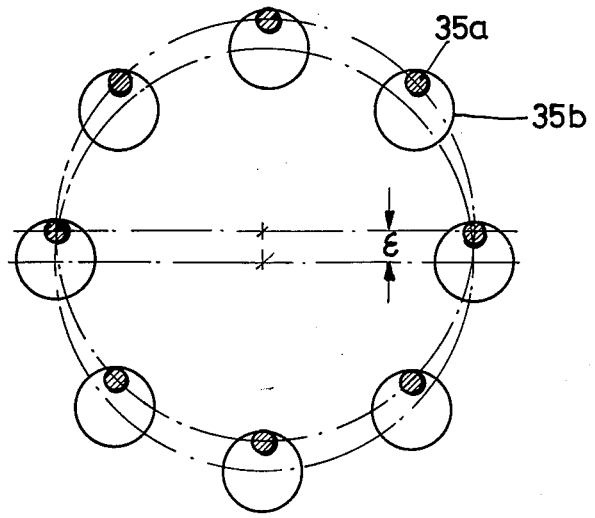
Figure 6:
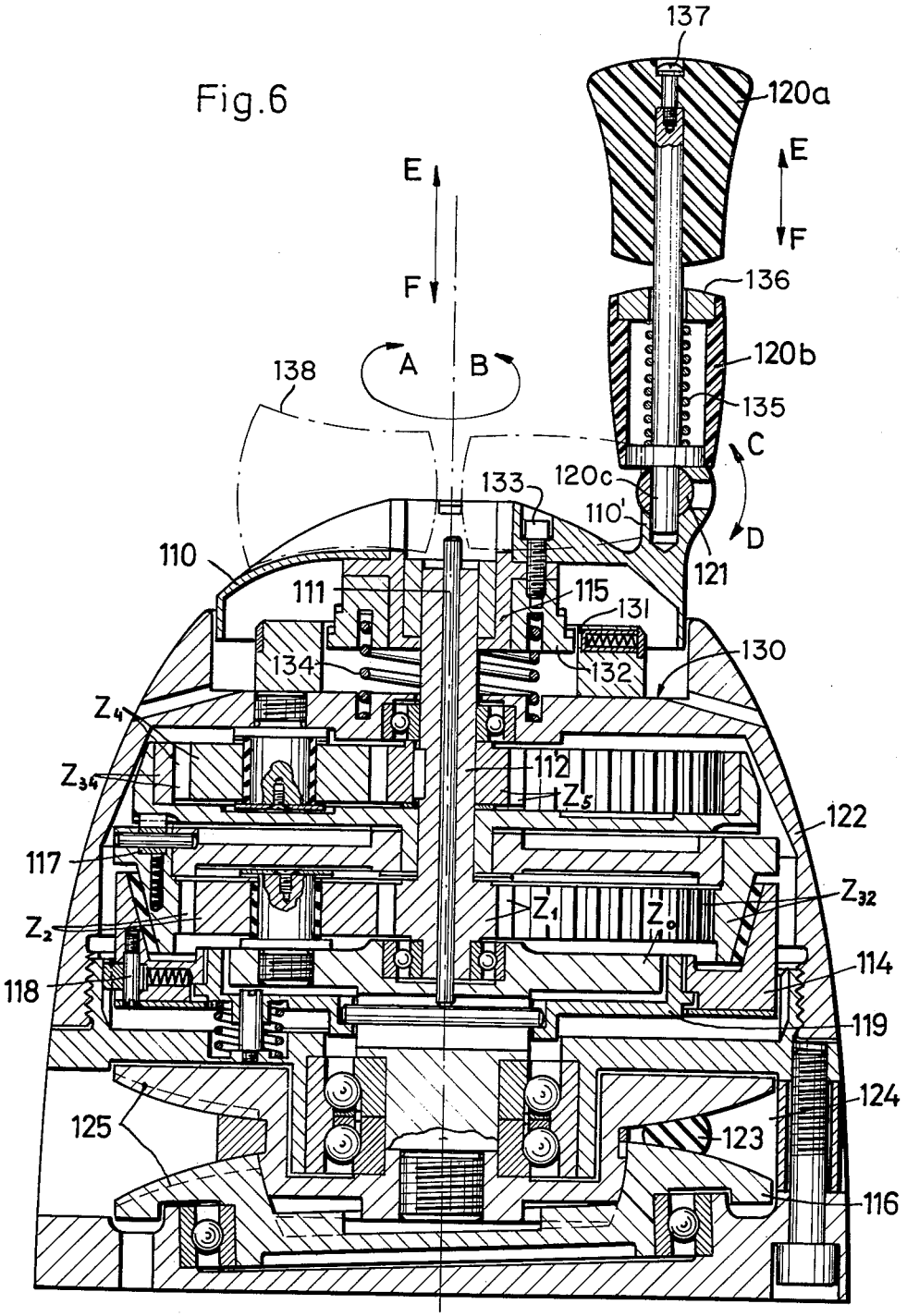

FIG. 2*a* shows a curve representing the variable spacing between the sides or flanks of the groove 12 of FIG. 1 as a function of the circumference or sheave;

FIG. 3 is a partial axial section of one embodiment of a control device which includes an emergency button;

FIG. 4 is a partial, axial section showing details of the region between an absolute arresting system and a profiled wobble plate forming part of a clamping pulley;

FIG. 5 is a sectional view of a clamping pulley including a two-part spherical joint;

FIG. 5*a* shows the spatial orientation of the extensions of one pulley member positioned in cylindrical recesses of the other pulley member, thereby forming the spherical joint of FIG. 5; and FIG. 6 is a partial axial section of a further embodiment of the invention.

DETAILED DESCRIPTION OF PREFERRED EXAMPLE EMBODIMENTS

FIG. 1 shows a winch or sheet hauling apparatus constructed according to the invention. The winch 1 comprises a housing 10, an upper cover member 2, and a lower cover member 3. A control device 41 including a handle 16 is arranged at the top of the winch. In the housing 10 there are arranged from top to bottom an arresting system 15, spring means 55 and 19*a* a conical brake clutch system 17, an auxiliary shaft member 22, the pulley members 11*a* and 11*b*, forming a clamping sheave 11, and a relative arresting system 14. The arresting system 15 may be either of the relative or absolute type.

In the configuration of FIG. 1, a rope 31 is looped in an angle of less than 360° about the clamping sheave or pulley 11.

An arresting system such as the absolute arresting system 15, for example, includes a spring 4, a blocking member 15*b*, and a grooved, retaining member 15*a*. The spring 4 keeps the blocking member 15*b* engaged with the retaining member 15*a* so that only motion in one direction of rotation is possible for the brake coupling member 17*a*, relative to the housing 10. Thus, the absolute arresting means operatively connects the coupling member 17*a* with the housing 10.

A relative arresting system 14 comprises an arresting member 14*b* which has an indentation 14*b*' extending partly circumferentially around it. Fastening means 51 connect a blocking member 50 to a rotatable member 14*a*. As member 14*a* rotates it will entrain the arresting member 14*b* because the blocking member 50 travels in the indentation 14*b*'. Thus, the relative arresting system 14 is operatively connecting member 14*b* with member 14*a*.

The clamp pulley 11 performs active and passive functions. The pulley 11 is passive when, for example, the rope 31 is moved and controlled by hand. The pulley 11 becomes active when it guides, moves, and controls the rope 31. The pulley is also operating actively when the rope is held in place by the clamping surfaces 13 of the pulley members 11*a* and 11*b*. The housing 10 includes openings 29 for the entry and exit of the rope 31. The slot 29 is in the plane of operation of a groove 12 of the pulley 11.

Initially the rope or sheet 31 is moved by hand in the pulling direction as long as it can be physically done by human force. For greater forces, the operator may release the rope or sheet 31 without hesitation because the rope 31 will be held or clamped between the clamping surfaces 13 of the sheave 11, which itself is locked by the absolute arresting system 15 against rotation in the reversed direction. In this situation, the intermediate members 14 and 17 form a quasi-rigid unit.

The sheet 31 is now hauled-in further by means of the control or operating device 41 including the handle 16. The control device 41 may be constructed as a ratchet arrangement. However, an even more efficient embodiment of the control device 41 may include a second relative arresting system instead of the ratchet. The second relative arresting system would be located directly adjacent to the absolute arresting system 15. The arresting of the rope in its end position takes place in the same manner regardless whether the rope 31 is operated by hand or by means of the handle 16.

A screw 5 rigidly secures the pulley member 11*a* to the arresting member 14*b*. Hence the pulley member 11*a* is rotatable around the bearings 6 as the member 14*b* rotates. The rotatable member 14*a* has shaft extensions 14*c* and 14*d*. Shaft extension 14*d* is rotatable within the bearing 6. A screw 8 connects a male conical brake coupling member 17*b* to the shaft extension 14*c* through a retaining member 7. The bearings 9 permit the shaft extension 14*c* to rotate about an axis 28*b*. The spring 19*a* maintains the contact between the brake coupling members 17*b* and 17*a*. The spring 19*a* is mounted between the coupling member 17*b* and the rotatable member 14*a*.

The control device 41 with its handle 16 must perform two functions:

(a) The control device 41, by means of the handle lever 16, transmits the driving force for the rope pulley 11. An intermediate gear drive 21 (FIG. 4) may be arranged between the pulley 11 and the handle 16 as will be described below.

(b) The control device 41, by pressing on it during a first phase of operation permits controlling the brake clutch system 17 either in a digital manner (FIG. 1) or in an analog manner (FIG. 4). In a second phase, the clamping pulley or roller 11 becomes completely free wheeling due to the relative arresting system 14. The free wheeling may be selected as desired by means of an arresting mechanism 34, shown in FIG. 3.

Referring to FIG. 1, a braking action may be initiated by pulling or releasing the operating lever 16. A substantially static operating condition of the clamping pulley 11 is achieved when the slippage of the brake coupling system 17 approaches the value zero. Finally, the operating lever 16 will be arrested in its horizontal working position.

As will be explained below, the present rope pulley 11 differs from previously known embodiments in six essential points.

Special care must be devoted to the clamping and releasing mechanisms since the present example embodiment of a winch is capable of handling large and the largest rope forces. Assuring a positive clamping of the sheet 31, providing an optimal free-running operability in both directions of rotation, and avoiding the pinching of the sheet 31 are considered of foremost importance.

The optimal clamping and a free-running operation are achieved by using a specific profile 13 in the groove 12 of the pulley 11, and by inclining the two roller or pulley axes 28*b* and 28*c* with respect to each other at a small angle $\epsilon$, as shown in FIG. 1.

FIG. 2 shows the curve of a so called profile 13 for the flanks 12*a* and 12*b* of the groove 12 formed in the circumference of the pulley 11. The profile 13 is an involute of a circle of radius R. The circle with the radius R is the base circle of the pulley 11. The bottom of the groove 12 of FIG. 1 corresponds to this base circle.

FIG. 2*a* shows the spacing variations between the flanks 12*a* and 12*b* of the groove 12 as a function of the circumferential extent of the pulley 11. A constant minimum spacing 40*b* will always be maintained. A variable spacing 40*a* is superimposed on the constant spacing 40*b*. The variable spacing 40*a* follows a sinusoidal variation or function.

The two flanks 12*a* and 12*b* of the groove 12 may also be constructed in accordance with e-functions. The e-function shape would lie in sectional planes extending in parallel to the pulley axes 28*c* and 28*b*, respectively. The slopes of the flanks 12*a* and 12*b* are determined by the clamping requirements to be met by the clamping profile 13.

The rope or sheet 31 cannot be securely held in the groove 12 on the spread apart side of the pulley 11. This applies in the pull and in the load direction. Hence, the rope 31 will fall out of the spread apart side. Prior art arrangements teach the lifting of the rope 31 out of a pulley groove with parallel flanks by means of a lift finger. These solutions however, have failed so far, because of the abrupt transition in which a fully elastic, free rope 31 becomes a solid body due to the clamping action. Thus, the rope 31 is frequently sheared off in prior art devices.

The invention solves the problem of the abrupt transition by assuring a harmonic or uniform transition action in such a manner that a shearing of the sheet cannot possibly occur despite an increased clamping force.

In order to keep the entry angle of the rope or sheet 31 into the pulley 11 as large as possible, it may happen that the rope 31 first enters the clamping region of the pulley. As a result, the rope 31 would not get into the widened region during the return motion of the pulley 11. However, the special shape of the profiles 13 of the invention prevents this possibility from occurring. The profiles 13 which form curved clamping ribs as shown in FIG. 2 on the flanks 12*a* and 12*b*, enable the rope 31 to exit perpendicularly relative to clamping ribs or profiles 13. Stated differently, the ribs 13 have such a curvature that the angle between the longitudinal direction of the sheet 31, and the tangent to such curvature at the contact point between the rope and the ribs is substantially a right angle.

The size of the angle of entry of the rope 31 also influences how the rope 31 is forced into the clamping region. A large entry angle automatically means that the rope 31 is pinched in the clamping region. This results in increased wear and tear on the rope 31. However, according to the invention, there is provided, as shown in FIG. 1, as asymmetrical collar 25 encircling the bottom of the groove 12. The collar 25 prevents the pinching of the rope 31 no matter what the angle of entry may be.

The bearing means 30*a*, 3*b* of the pulley members 11*a* and 11*b* are made to include self-lubricating packings or sealings 30*a*, 30*b*. The sealings 30*b* are shown in FIG. 4. The sealing means 30*a*, 30*b* are especially resistant to sea water. These packings or sealing means are effective in the various rotational positions of the pulley 11, whereby undefined upsetting moments ae avoided regardless of any transverse forces caused by the sheet 31. The sealings 30*a*, 30*b* are preferably made of carbonaceous materials. The two pulley members 11*a* and 11*b* bear against each other substantially in a point 23, whereby the bearing forces in the packings 30*a*, 30*b* are reduced.

The relative freedom of motion of the pulley members 11*a* and 11*b* with respect to each other is a considerable advantage. Another advantage is seen in the very simple construction compared to the prior art.

FIG. 5 shows an axial section of a two member joint according to the invention. The configuration of FIG. 5 may be used to accurately establish a tilt angle $\epsilon$ between the axes 28b and 28c of FIG. 1. This achieves the maximum possible freedom of movement for the pulley members 11a'' and 11b''.

FIG. 5a is a projection in the plane $V_a$— $V_a$ of FIG. 5, of the cylindrical extensions 35a in the cylindrical recesses 35b. FIG. 5a shows the seating and orientation of the extensions 35a of the pulley member 11a'' in the recesses 35b of the pulley member 11b''.

The two pulley members 11a and 11b of FIG. 1 may even be fully rotatable relative to each other where the effective forces are small and the looping angle of the rope 31 is greater than 180°. In any event, the clamped rope 31 is almost a solid body between the two pulley members 11a and 11b, whereby it functions as a quasi-connection between the pulley members. This quasi-connection causes or at least assists in entraining the pulley members in response to pull on the rope or sheet.

In accordance with the method of the invention, an operator must be able to haul in the rope 31 over the pulley 11 by hand during the first phase of operation. Further, the motion of the rope 31 must be arrested immediately when the rope 31 is released. These requirements are met by the cooperation between the two arresting systems 14 and 15.

FIG. 4 shows a further embodiment, wherein the central portion is shown, the upper and border portions being omitted. A hard to turn pulley is not desirable. This applies in the pulling direction as well as in the load direction. Such a pulley would be directly connected to a gear drive 21 and movable only relative to the absolute arresting system 15'. This is also true for the load direction, since even the smallest wind must be taken into account and a stuck sheet must definitely be avoided. A hard to turn pulley or a stuck sheet are avoided by the invention due to the relative arresting system 14 or 14'.

In FIG. 4, the relative arresting system 14' comprises two coupling members 14a' and 14b'. The members 14a' and 14b' are made of low friction materials. The coupling member 14a' is secured to an axle 33 which is rotatable about an axis 28b, as shown in FIG. 4. A spring 44 maintains the contact between the coupling members 14a' and 14b'. The coupling members 14a' and 14b' engage each other at a sawtooth-shaped interface, whereby free rotation in the pulling direction is possible since the coupling members 14a' and 14b' easily slide relative to each other because of the described substantially frictionless contact between them. For rotation in the load direction the members 14a' and 14b' are disengaged from each other and the return movement of the pulley 11' is only subject to bearing friction. Thus, undesired movements of the control device, especially the handle 16, which is not shown in FIG. 4, are also avoided.

An absolute arresting system 15' prevents an unwanted return run of the pulley 11' at all times. The arresting system 15' does, however, allow the pulley 11' to move in the pull direction with the aid of the control device 16, of FIG. 1.

FIG. 4 shows a gear drive 21 interposed between the shaft 33, and the relative arresting device 14'. The gear drive 21 provides the necessary force reduction. A coaxial gear drive is preferred because the relative arresting system 14' may be controlled through the shaft of such a gear drive.

It is especially advantageous to employ a planetary wheel gear system in the gear drive 21, because in such systems gear teeth are not required directly at the point of force introduction, whereby small gear wheels may be used in such a drive.

According to the invention, the pully 11' of FIG. 4, which may be referred to as a wobble plate, is used in combination with a cone friction clutch 17' interposed between two spring systems 18 and 19b.

Due to the force reduction, large loads on the side of the pulley member 11a' may be held in place, braked, and released by applying small spring forces on the side of the force reduction. In this way, the two spring systems 18' and 19b resolve the length of each effective step of the cone friction coupling 17' into any desired number of small steps instead of the normally digital or stepwise operation. The number of these small steps is now only a function of the desired braking continuity. The normally digital or stepwise operation of the cone friction clutch 17' is sufficient for certain applications, see FIG. 1. However, with the emboiment of FIG. 4, a smooth substantially continuous operation is now possible.

The special construction of the control device 41 of FIG. 1 allows the winch operation with one hand. The rope or sheet 31 may be hauled in by turning the handle 16 of the control device 41. The motion of the rope 31 may also be slowed down by pressing down the lever 16 of the control device. The rope 31 may be released, free of forces, in the final stopped or arrested position. To do this, movements in at least three directions are required. One of these movements is always the rotation around the pulley axis 28b. This rotational movement is used to haul in the sheet 31. The two remaining movements may be carried out in the directions of the pulley axis 28b in order to brake, release and arrest the sheet 31.

FIG. 3 shows another embodiment of a control device 41' according to the invention for avoiding an unintentional release of the sheet 31 in the winch. For this purpose the lever 16a must be arrested, for example, by means of a spherical retaining element 34 snapping into a respective recess 34', at least when the lever 16a is in a final horizontal functional position.

A self adjustable spherical retaining member 16c, shown in FIG. 3, may be used to secure the handle 16a to the shaft of the winch so that the control device 41' need not be repeatedly adjusted each time the brake clutch members 17a and 17b (FIG. 1) have been worn down. In an alternative embodiment the lever 16a may be removably mounted on the winch shaft by a bushing 16b. The lever 16a is attached to the bushing 16b so as to be rotatable about the axis 28b.

The angular movement of the operating lever or handle 16a may become large as a result of the resolution of the operational steps of the cone friction clutch members 17a and 17b (FIG. 1). However, the angular movement of the operating lever 16a should be kept small. FIG. 3 gives an example of how this may be done by a parallel shift or translation of the point of rotation 28a. The rotation point 28a in FIG. 3 corresponds to the point 28a of FIG. 1.

The winch, when it is under the pressure of the rope 31, may also be operated without a control device 41'. The winch may be operated by foot. An appropriately shaped knob 26' of FIG. 3 or 26 of FIG. 1 is provided for this purpose. The knob 26 or 26' is mounted on the auxiliary axle 22 or 22', respectively.

FIG. 6 shows a further embodiment of a sheet hauling winch according to the invention. A clamping pulley 116, is used to move and hold a rope 123 directly and without any substantial force exertion. The rope 123 is moved by means of a gear drive Z, when high forces must be overcome.

This embodiment is particularly advantageous in that the return motion of the rope 123 due to the disengagement of a clutch 114 occurs exclusively with the bearing friction of the roller 116. Thus, the return motion of the rope 123 no longer subjects the rope to the full friction of the rope against the winch. This is an advantage over the prior art.

The rope 123 is guided into a clamping roller groove 124 and pulled in the direction of rotation B (pull direction) by hand until a limiting force is reached. The operator then releases the rope or sheet 123. The counteracting force — e.g., the force on the sail — now pulls the sheet 123 into the clamping profiles 125, whereby the rope 123 is held in a slip-free manner.

The smaller gear ratio of a planetary wheel gear system Z is designated by $i_1$. For $i_1$ the direction of rotation of a control device 110 is the same as that of the clamping roller 116. A main shaft 112 surrounds an auxiliary shaft or pin 111, as shown in FIG. 6. Rotation of the main shaft 112 moves the gear wheels $Z_1$ and $Z_5$ in the same direction. The gear wheel $Z_5$ drives a gear wheel $Z_4$ rotatably secured to a housing 122 of the hauling winch. The gear wheel $Z_4$ rotates in the direction opposite to that of wheel $Z_5$ and drives a differential ring gear $Z_{34}$. The ring gear $Z_{34}$ rotates in the same direction as the gear wheel $Z_5$. The ring gear $Z_{34}$ does not, however, entrain a differential ring gear $Z_{32}$ because a relative arresting system 117 is free wheeling in this relative direction of rotation.

The gear wheel $Z_1$ drives a gear wheel $Z_2$. The gear wheel $Z_2$ meshes with the differential ring gear $Z_{32}$. The ring gear $Z_{32}$ is fixed in its rotational position relative to the housing 122 by a clutch 114 and by an absolute arresting system 118 in this operative force direction, i.e., direction B of FIG. 6.

Hauling-in of the sheet 123 may continue until the steadily increasing counter force reaches a limit defined by the operating lever or handle 120. The clutch 114 will slip at any force larger than this limit. The operator would then be turning the handle without any effect. The winch is thus protected from overloading.

The control device 110 will now be rotated in the direction of rotation A, the load direction, whereby a larger gear ratio or translation $i_2$ is involved. The gear wheels $Z_5$ and $Z_1$ are turning in the same direction. The gear $Z_4$ reverses its direction of rotation. Thereby the direction of the ring gear $Z_{34}$ is also reversed. The relative arresting system 117 blocks rotation in this relative direction, whereby the differential ring gear $Z_{32}$ must move in the same direction as the ring gear $Z_{34}$. The clutch 114 is free-wheeling in this direction due to the absolute arresting system 118.

The gear $Z_2$ is rotatably secured to a bridging member $Z_0$ which moves in a direction opposite to the direction of rotation of the control device 110. The clamping pulley or roller 116 is secured to the bridging member $Z_0$. Therefore, the roller 116 also rotates opposite to the direction A of the rotation. However, this is the original direction B and thus, the rope 123 is hauled-in further.

The return motion of the pulley 116 is blocked by releasing the lever 120. This blocking is a result of the self-locking action of the planetary gears Z in the load direction A, just as in the previous cases.

The gear ratios $i_1$ and $i_2$ may be defined by the following relationships:

$$i_1 = \frac{n_1}{n_s} = 1 + \frac{Z_{32}}{Z_1}$$

$$i_2 = \frac{n_1}{n_s} = \frac{1 + \frac{Z_{32}}{Z_1}}{1 - \frac{Z_5 \cdot Z_{32}}{Z_1 \cdot Z_{32}}}, \text{ for } \frac{Z_5 \cdot Z_{32}}{Z_1 \cdot Z_{34}} > 1,$$

wherein Z with the respective index refers to the above discussed gears, whereas $n_1$ is the r.p.m. of the lever 120 and $n_s$ is the r.p.m. of the roller or pulley 116.

It is desired to let the rope 123 run in the reverse direction, the operator depresses the control device 110 using the handle 120 downwardly in the direction F with the handle 120 in its vertical position. This moves a coupling 115 down, whereby the auxiliary pin 111 activates a disengagement member 119. The disengagement member 119 pushes the clutch 114 down, whereby the planetary gears Z are relatively free to rotate.

An optimal freedom of motion for the gears is achieved by arranging the relative arresting system 117 between the differential ring gear $Z_{34}$ and the clutch 114. In other words, the clamping roller 116 rotates without a noticeable opposing force in the load direction A after pressure is applied in the direction F.

The motion of the unwinding rope 123 is brought to an immediate standstill by releasing the control device 110, when little kinetic energy occurs in the load direction. However, the operator can also depress the control device 110 until it contacts a stop 130, see FIG. 6. This compresses a spring 134 against the housing 122. The operating device will be locked in this position by the arresting system 131 which engages a reset member 132. The control device 110, the coupling member 115, and the reset member 132 are secured with a bolt 133. The control device 110 remains pressed against the stop 130 and arrested until a definite rotation takes place in any direction (A,B) about the main shaft 112. The reset member 132 is constructed so that a rotation of the shaft 112 will cause the return of the control device 110 by the release of the spring 134 which had been compressed.

The return of the control device 110 to its original position leads to a self-locking situation in which the clutch 114 once again engages the differential ring gear $Z_{32}$.

As shown in FIG. 6, the operating handle 120 comprises grip members **120*a* and 120*b*, longitudinal axis or shaft 120*c* and a tilting axis 121** extending perpendicularly to the longitudinal axis 120*c*, a spring 135, and a retaining member 136. A screw 137 secures the grip member **120*a* to the longitudinal shaft 120*c*. This axle combination is mounted in an upright extension 110' of the control device 110. The spring 135 keeps the handle 120 locked in position against the extension 110'. The handle 120 may be pulled in the direction E and then tilted in the direction C until it is in a horizontal position as indicated by the phantom lines 138. In this position, the handle 20 fits the contour of the control device 110** of the winch.

A planetary gear Z, and therefore the entire winch, is locked in its position by pulling and tilting the operating handle 120 in the direction E and C as described, and then pushing downwardly in the direction F. This situation may be terminated by returning the operating handle 120 to the vertical position.

In a further embodiment, the handle 120 may be brought to a ratcheting position by tilting it in the direction D to assume a horizontal, radially outwardly extending position. This action causes the control device 110 to be moved downwardly by a predetermined amount.

The example embodiments of the invention have quite substantial advantages over all previously known embodiments of the prior art. Above all, the invention enables the absolutely safe one-hand operation which has not been possible with any prior winch. The invention is also absolutely reliable in operation and just as absolutely accident-proof.

The differential planetary gear system with an integrated coupling and arresting system makes possible gear ratios from 1 to any desired value. Also, the braking force applied to the clutch is only the force difference between the two differential ring gears. Therefore, the pressure which must be applied to the control device 110 becomes substantially independent of the force of the rope. The strength of available materials now determines the size of the gear drive, instead of the gear ratio *i*.

Large force applying levers at the control device 110 are no longer necessary. Large gear ratios have been realized in an economical and space saving manner. Therefore, the winch can be mounted anywhere in a space-saving manner without curtailing its usefulness. Further, the winch features of the invention merge easily into the entire winch structure.

According to a third embodiment, the clutch 114 may be inserted between the pulley 116 and the planetary wheel gear system Z including bridging member $Z_0$. This embodiment is especially suitable when the braking paths must be kept small because of possibly large kinetic energies. For this purpose a force reduction gearing must be connected between the auxiliary arrangement 111 and the disengagement member 119. Such force reduction is necessary in order to maintain control over the large coupling forces. The absolute freedom of motion of the clamping roller or pulley 116 is also guaranteed in this case. The wear and tear of the brake linings associated with continual braking action is automatically adjusted at the auxiliary arrangement 111.

The winch cannot be overloaded even when a large gear ratio is used, since the clutch slips when a defined limiting force is reached. Such an operation greatly increases the operational life of the present winch.

The possibility of bringing the handle into a cranking position by tilting in the direction D provides the advantage that the lever force can be increased in a defined manner while maintaining a uniform rotational translation. In this case, however, the limiting forces which cause the clutch to slip must be increased.

The chosen egg-shape of the housing 122 assures a high strength and simultaneously a light weight structure, it also assures that any items abroad, such as sheets, will safely slip off the winch. Finally, it is no longer possible to lose the operating handle of the winch. The operating handle is an integral component part of the rounded unit, and it is always ready for service.

Although the invention has been described with reference to specific example embodiments, it is to be understood, that is it intended to cover all modifications and equivalents within the scope of the appended claims.

What is claimed is:

1. An apparatus for the slip-free hauling of rope means, comprising housing means, clamping pulley means in said housing means, braking means, relative arresting means operatively connecting said clamping pulley means with said braking means, means operatively connecting said clamping pulley means to said relative arresting means, control means, absolute arresting means operatively connecting said control means with said housing means, auxiliary means operatively connecting said control means to said relative arresting means, first and second spring means operatively connecting said braking means to said absolute and relative arresting means, respectively, whereby said housing means operatively position said recited means, said control means being adapted to initiate and control the braking, releasing, and arresting of said slip-free hauling in such a manner that a looping angle of less than 360° of said rope means relative to said clamping pulley means is maintained at all times.

2. The apparatus of claim 1, further comprising force reduction means operatively connecting said relative arresting means to said absolute arresting means.

3. The apparatus of claim 2, wherein said relative arresting means comprise first toothed clutch means, and wherein second toothed clutch means operatively engage said first toothed clutch means.

4. The apparatus of claim 3, wherein said first clutch means is made of synthetic material, and said second clutch means is made of metal.

5. The apparatus of claim 2, wherein said force reduction means comprise interchangeable gear means, preferably coaxial gear means.

6. The apparatus of claim 1, further comprising force reduction means operatively connecting said clamping pulley means to said absolute arresting means.

7. The apparatus of claim 1, wherein said clamping pulley means comprise first and second side members forming variable circumferential groove means, said first and second side members comprising profiled and curved ridges (13) facing each other and corresponding to an involute of the base circle of said circumferential groove means or to an *e*-function curve.

8. The apparatus of claim 7, wherein said groove means defines a spacing between said first and second side means which spacing has a sinusoidal variation and a constant component.

9. The apparatus of claim 7, further comprising asymmetric collar means operatively positioned in said groove means thereby preventing pinching of said rope means.

10. The apparatus of claim 1, wherein said clamping pulley means comprises first and second pulley members forming a variable width circumferential groove, said first pulley member having a first rotational axis, said second pulley member having a second rotational axis, and connecting means operatively connecting said first pulley member to said second pulley member for forming a predetermined angle ($\epsilon$) between said first and second axes, whereby the cross-section of said circumferential groove is varied around the circumference of the groove.

11. The apparatus of claim 10, wherein said means opeatively connecting said first and said second pulley member are adapted to permit relative rotation between said pulley members for narrowing of said groove to clamp said rope means and for widening said groove to release said rope means.

12. The apparatus of claim 10, wherein said means operatively connecting said first and second pulley members comprises bracing means providing substantially for a point-like contact between said first and second pulley members.

13. The apparatus of claim 10, wherein said connecting means comprises universal or ball-and-socket joint means.

14. The apparatus of claim 9, wherein said first pulley member comprises a plurality of recesses, and wherein said second pulley member comprises a plurality of projections operatively engaging said plurality of recesses.

15. The apparatus of claim 1, wherein said braking means comprises female conical clutch means and male conical clutch means operatively engaging said female clutch means, said clutch means being axially slidable along a centril axis, said clutch means being operatively connected by said first and second spring means.

16. The apparatus of claim 1, further comprising knob means, means operatively connecting said knob means to said auxiliary means, and means operatively engaging said knob means with said control means thereby providing an emergency operation capability.

17. The apparatus of claim 1, wherein said control means comprise lever means having a handle end and a tilting end, and control members operatively connecting said lever means to said clamping pulley means which is rotatable by said lever means about a central axis, said tilting end of said lever means being tiltable about a further axis extending in a plane which is perpendicular to a plane in which said central axis extends.

18. The apparatus of claim 17, wherein said absolute arresting means comprise journal means rotatable about said central axis, said control means further comprising means operatively securing said lever means to said journal means in a slidable manner along said central axis.

19. The apparatus of claim 17, wherein said absolute arresting means comprises journal means rotatable about said central axis, said control means further comprising spherical retaining means operatively securing said control member to said journal means.

20. The apparatus of claim 17, further comprising means operatively connecting said tilting end of the lever means to said absolute arresting means thereby providing translation of motion about said further axis.

21. The apparatus of claim 17, further comprising means capable of operatively engaging said lever means with said housing means thereby releasably securing said lever means in a final depressed locking position.

22. The apparatus of claim 1, wherein said control means comprise ratchet means.

23. The apparatus of claim 1, further comprising second relative arresting means operatively connecting said control means with said absolute arresting means.

24. The apparatus of claim 1, further comprising second relative arrresting means operatively integrally connected to said absolute arresting means, and means operatively connecting said control means with said second relative arresting means.

25. The apparatus of claim 1, wherein said clamping pulley means comprise circumferential groove means and wherein said housing means compise rope entrance and exit openings in the plane of operation of said circumferential groove means of the clamping pulley means.

26. The apparatus of claim 1, further comprising bearing support means operatively positioning said clamping pulley means in said housing means, said bearing support means including self-lubricating sealing materials which are acid- and alkali-resistant, preferably carbonaceous material.

27. An apparatus for the slip-free hauling of rope means, comprising housing means, control means, clamping pulley means, clutch means, journal means having a first end and a second end, auxiliary shaft means, means operatively holding said auxiliary shaft means within said journal means in an axially slidable manner, coupling means operatively connecting said control means to said auxiliary shaft means, means operatively rotatably connecting said pulley means to said second end of the journal means, engagement means operatively engaging and disengaging said clutch means with said auxiliary shaft means, and wherein said housing means operatively position said recited means relative to each other and relative to the housing means in such a manner that said slip-free hauling of said rope means is accomplished while maintaining a looping angle of less than 360°, said control means comprising control handle means, first axle means, means operatively connecting said control handle means to said first axle means in an axially slidable manner, second axle means operatively and rotatably connecting said first axle means to said control handle means, the axis of rotation of said second axle means extending perpendicularly to said first axle means, said control handle means thereby being capable of disengaging said clutch means by axially moving said auxiliary shaft means, said apparatus further comprising gear means operatively connecting said clamping pulley means to said control means, and means operatively locking said gear means in the load direction when said control handle means is tilted about said second axle means into a downwardly depressed position.

28. The apparatus of claim 27, further comprising planetary gear means operatively connecting said clamping pulley means to said control means in a force reduction manner with two step-down gear ratios $i_1$ and $i_2$ given by the formulas:

$$i_1 = \frac{n_1}{n_s} = 1 + \frac{Z_{32}}{Z_1} \text{ and}$$

$$i_2 = \frac{n_1}{n_s} = \frac{1 + \frac{Z_{32}}{Z_1}}{1 - \frac{Z_5 \cdot Z_{32}}{Z_1 \cdot Z_{34}}}, \text{ for: } \frac{Z_5 \cdot Z_{32}}{Z_1 \cdot Z_{34}} > 1,$$

where: Z equals the number of teeth of the respective gear, and $Z_{32}$ and $Z_{34}$ refer to differential ring gears, and wherein $n_1$ is the r.p.m. of said control handle means, whereas $n_s$ is the r.p.m. of said clamping pulley means.

29. The apparatus of claim 28, wherein said clutch means are conical, said apparatus further comprising means operatively positioning said conical clutch means between said differential ring gear $Z_{32}$ and said housing means, and absolute arresting means operatively connecting said conical clutch means with said housing means.

30. The apparatus of claim 29, further comprising relative arresting means operatively connecting said differential gear $Z_{34}$ with said differential gear $Z_{32}$.

31. The apparatus of claim 29, further comprising relative arresting means operatively connecting said differential gear $Z_{34}$ with said conical clutch means.

32. The apparatus of claim 28, further comprising absolute arresting means operatively connecting said differential ring gear $Z_{32}$ with said housing means, and means operatively connecting said clutch means between said planetary gear means and said clamping roller means.

33. The apparatus of claim 32, further comprising force reduction means operatively connecting said engagement means to said shaft means, said force reduction means comprising force translation lever means.

34. The apparatus of claim 32, further comprising force reduction means operatively connecting said engagement means to said control means, said force reduction means comprising force translation lever means.

35. The apparatus of claim 27, further comprising means releasably securing said control means in the final depressed position, and means activated by rotation of said journal means for releasing said control means from said final position.

36. The apparatus of claim 35, wherein said housing means is rounded, said housing means being tapered upwardly in an egg shape.

* * * * *

UNITED STATES PATENT OFFICE

CERTIFICATE OF CORRECTION

Patent No. 4,120,486 Dated October 17, 1978

Inventor(s) Walter Mehnert

It is certified that error appears in the above-identified patent and that said Letters Patent are hereby corrected as shown below:

Claim 14, line 1, "claim 9" should read -- claim 10 --.

Signed and Sealed this

Sixth Day of February 1979

[SEAL]

*Attest:*

RUTH C. MASON
*Attesting Officer*

DONALD W. BANNER
*Commissioner of Patents and Trademarks*